US010737909B2

(12) United States Patent
Gartner et al.

(10) Patent No.: US 10,737,909 B2
(45) Date of Patent: Aug. 11, 2020

(54) ESCALATOR STEP COMPRISING PLUG-IN PARTS

(71) Applicant: INVENTIO AG, Hergiswil (CH)

(72) Inventors: Manfred Gartner, Felixdorf (AT); Reinhard Fukerieder, Wiener Neustadt (AT); Thomas Novacek, Schwechat (AT)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 16/328,872

(22) PCT Filed: Aug. 31, 2017

(86) PCT No.: PCT/EP2017/071826
§ 371 (c)(1),
(2) Date: Feb. 27, 2019

(87) PCT Pub. No.: WO2018/041929
PCT Pub. Date: Mar. 8, 2018

(65) Prior Publication Data

US 2019/0210843 A1 Jul. 11, 2019

(30) Foreign Application Priority Data

Aug. 31, 2016 (EP) ..... 16186553

(51) Int. Cl.
*B66B 23/00* (2006.01)
*B66B 23/12* (2006.01)

(52) U.S. Cl.
CPC ..... *B66B 23/12* (2013.01)

(58) Field of Classification Search
None
See application file for complete search history.

(56) References Cited

U.S. PATENT DOCUMENTS

| | | | | |
|---|---|---|---|---|
| 5,337,879 | A | 8/1994 | Fischer | |
| 6,543,599 | B2 * | 4/2003 | Jasinetzky | B66B 23/12 198/333 |
| 8,322,508 | B2 * | 12/2012 | Matheisl | B66B 23/12 198/326 |
| 8,469,176 | B2 * | 6/2013 | Matheisl | B66B 23/12 198/333 |

(Continued)

FOREIGN PATENT DOCUMENTS

| | | |
|---|---|---|
| CN | 101648669 | 2/2010 |
| CN | 103545650 A | 1/2014 |
| CN | 203568655 U | 4/2014 |

(Continued)

OTHER PUBLICATIONS

International Search Report for International Application No. PCT/EP2017/071826 dated Nov. 7, 2017.

*Primary Examiner* — Kavel Singh
(74) *Attorney, Agent, or Firm* — Knobbe Martens Olson & Bear LLP

(57) ABSTRACT

The application relates to an escalator step that includes a single-piece tread body, two side cheeks, and at least one supporting profile, which are all formed as plug-in parts and comprise plug-in connections. Owing to this division into plug-in parts, the escalator steps can be transported more effectively in disassembled form and put together in a very simple manner at the assembly site.

17 Claims, 6 Drawing Sheets

(56) References Cited

U.S. PATENT DOCUMENTS 9,802,791 B2 * 10/2017 Ludwig ..... B66B 23/10

FOREIGN PATENT DOCUMENTS

| | | |
|---|---|---|
| DE | 199 19 710 | 11/2000 |
| JP | 2010126280 | 6/2010 |
| WO | WO 2009/047146 | 4/2009 |
| WO | WO 2015/032674 | 3/2015 |

* cited by examiner

ESCALATOR STEP COMPRISING PLUG-IN PARTS

TECHNICAL FIELD

This application relates to an escalator step and to a method for the production thereof.

SUMMARY

Escalators are widely known, efficient devices for moving people. Escalator steps are designed as either single-piece or multi-part components and are generally produced by casting, extrusion, or forging processes, but also as deep-drawn parts. In addition, mixed forms comprising both cast parts and sheet metal parts are also known. Escalator steps of the type mentioned at the outset are disclosed in WO2015/032674 A1, for example. The top face of the escalator step comprises a tread pattern in the form of a series of parallel ribs or ridges extending from the front to the back. The ribs thus extend in the intended movement direction of the escalator step. The riser element of said step also comprises ribs, which usually adjoin the ribs of the top face. Furthermore, the ribs are dimensioned so as to engage in the comb structures arranged at the entrance areas of the escalator or moving walkway.

A plurality of steps can be connected by at least one tensioning mechanism to form a step band of an escalator. An escalator generally comprises a load-bearing structure or structural framework comprising two deflection portions, between which the step band is guided in a circulating manner.

If the pallets or steps are made in one piece from cast or diecast aluminum or another suitable metal or of a metal alloy, this may require an extremely complex mold. Molds of this kind for escalator steps are very expensive. In addition, the size of these moldings can lead to casting problems, specifically to cavitation, in particular in the region of the ribs and grooves, and so the molds can require laborious tempering to prevent this.

To solve this problem, WO2015/032674 A1 proposes escalator steps comprising separate tread plates, wherein the tread plates are arranged on a sheet steel step skeleton or on an extruded tubular body with hooks that protrude thereunder.

Escalator steps of the aforementioned type, or the step skeleton or tubular body thereof, enclose a largely trapezoidal cross section transversely to the ribs and grooves of their tread elements, the escalator steps being formed from thin walls and supports. As a result, they have a very large volume but a small mass. This make it difficult to transport the escalator steps from the production site to the assembly site at which the escalator step is installed in an escalator. In a standard container, therefore, only a comparably small number of escalator steps can be transported in relation to the maximum permitted transport weight.

An object of the present application is therefore to provide escalator steps that are optimized for being transported from the production site to the assembly site.

This object is achieved by an escalator step comprising a single-piece tread body having a tread element portion and a riser element portion, the tread element portion and the riser element portion forming an L-shaped cross section of the single-piece tread body. The escalator step further comprises two side cheeks, which can be arranged on both sides of the single-piece tread body. Furthermore, the escalator step includes at least one supporting profile, which can be arranged between the side cheeks. The single-piece tread body, the side cheeks, and the supporting profile are formed as plug-in parts and thus comprise plug-in connections. With these plug-in connections, the supporting profile can be connected to the side cheeks, and the single-piece tread body can be connected at least to the side cheeks to form an escalator step.

This disclosure is based on the finding that, for production reasons, the plug-in connections may intrinsically have play and thus a tightly defined freedom of movement. To largely eliminate the effects of any potential play within the plug-in connections of the escalator step according to the invention, use is made in particular of the stabilizing nature of the L-shaped cross section of the single-piece tread body. In other words, for stability reasons the riser element portion and the tread element portion are integrally interconnected and thus formed as a single-piece tread body.

In the escalator step according to the disclosure, plug-in connections are preferably provided between the single-piece tread body and the side cheeks, between the side cheeks and the supporting profile, and between the single-piece tread body and the supporting profile. As a result, the plug-in connections also restrict one another in terms of their play-related movement of freedom, and so an entirely rigid escalator step is created by simply plugging the plug-in parts together.

By dividing the escalator step into a single-piece tread body, two side cheeks, and a supporting profile, which are designed as plug-in parts, the escalator step can be transported in a space-saving manner disassembled into individual parts. While the escalator step must still be put together at the assembly site, this can be done without any problems in a very simple manner due to the plug-in connections. Since said parts are designed as plug-in parts, they can even be put together in a completely automated manner by robots or automatic assembly machines.

In addition, the plug-in connections allow for an extremely sturdy, in particular, dimensionally stable connection, between the single-piece tread body and the side cheeks and supporting profile. Preferably, there is no inordinate play within the plug-in connections. The plug-in connection can even have a sliding fit, or a simple press fit. If the plug-in connection can be plugged together in only one assembly direction, said connection has a high positioning role in just one degree of freedom. This helps prevent incorrect assembly.

The assembly direction of the individual plug-in connections can be arranged orthogonally to a main loading direction of the respective plug-in connections, such that the largest force acting within the plug-in connection can be absorbed by the interlocking of the plug-in connection. This means that strain on securing mechanisms, used to secure the plug-in connection, is largely relieved and said securing mechanisms can be given very small dimensions. For individual plug-in connections, a securing mechanism may possibly be omitted.

In the process, the assembly direction can be curved such that the plug-in connection can be joined together with a pivot movement. It goes without saying that the assembly direction can also be linear, such that the plug-in connection can be joined together by a linear movement.

Each plug-in connection comprises at least one protrusion and at least one recess matched to said protrusion in an interlocking manner. Each of the plug-in connections is always divided into two plug-in parts, the recess being formed in one plug-in part of the escalator step and the protrusion to be inserted into said recess being formed on another plug-in part that adjoins the plug-in part having the recess when in the assembled state.

Preferably, at least one of the plug-in connections is secured by a securing mechanism. This can be done by means of a bonding securing means, e.g. a polymer adhesive, by soldering, or by welding. It goes without saying that the at least one plug-in connection can also be secured in an interlocking manner, in that, for example orthogonally to the assembly direction, a splint, a rivet, a pin, or a screw, which pass through both the material forming the recess and the protrusion. Snap-in connections formed in parallel with the plug-in connection may also be possible. Other possible interlocking securing mechanism are caulking or clinch connections. The securing mechanism prevents the secured plug-in connection from releasing. It goes without saying that a combination of bonded and interlocking securing mechanism can be used on the same escalator step or even on the same plug-in connection. Since the plug-in connections are preferably designed such that the largest force acting within the plug-in connection is absorbed by the interlocking of the plug-in connection, the securing mechanism can be given very small dimensions or be designed to transmit hardly any load.

In principle, the plug-in parts can be made of different materials and made using different production methods. To avoid having to rework protrusions and recesses, however, the plug-in parts are preferably light-metal diecast parts. Aluminum alloys are particularly suitable casting materials.

It goes without saying that at least two plug-in connections can be provided between two adjacent plug-in parts to be joined together. A plurality of plug-in connections increases the mechanical stability between the two joined parts.

Various fastening regions and designs having special functions can be formed on the plug-in parts. For example, an emergency guide hook can be formed on at least one of the side cheeks. Said emergency guide hook can protrude beneath an emergency guide rail or a runner rail of an escalator in which the escalator step is used, thus preventing the escalator step lifting off the runner rail.

In addition, at least one of the following fastening regions can be formed on the side cheeks or on the single-piece tread body in order to fasten add-on parts:

- an idling roll fastening region for fastening an idling roll,
- a step spindle fastening region for fastening a step spindle, or
- a guide fastening region for fastening a sliding guide element that guides the escalator step at the side during operation.

A number of fully plugged-together escalator steps provided with securing means and add-on parts are arranged between two tensioning means and form a step band. The first and second tensioning means are usually sprocket chains provided with castors. As is known, the step band is arranged in a circulating manner in an escalator.

The above-described escalator step is produced and assembled at least by means of the following steps: First, the single-piece tread body, side cheeks and supporting profile required for producing the escalator step are produced as plug-in parts, for with a light-metal diecasting process, with recesses and protrusions for the plug-in connections being formed on the plug-in parts. Next, the plug-in parts of the escalator step are plugged together with the plug-in connections formed on said parts to form an escalator step by firstly arranging the supporting profile between two side cheeks, plugging said profile and cheeks together, and then plugging the single-piece tread body to the side cheeks and to the supporting profile arranged therebetween. After having been plugged together, at least one of the plug-in connections is secured with an interlocking or bonded securing mechanism. Further add-on parts such as idling rolls, emergency guide hooks, sliding guide elements, and the like are possibly fastened to the escalator step to complete the escalator step.

In very infrequent cases, the escalator step production plant is attached to an escalator step assembly plant. Normally, escalator steps are produced in high volumes in a production plant and then shipped worldwide to escalator step assembly plants. Since, according to the present invention, the main components of the escalator step are plug-in parts, said parts can be packed and transported in a very space-saving manner. This results in outstanding utilization of the available transport volume, for example, of a transport container, as specified in the ISO 678 standard, and transport can be carried out by container ship, railway, and trucks. To simplify the transport of escalator steps from the production site to the assembly site, according to the disclosure, the escalator steps are produced in the form of plug-in parts, the plug-in parts of an escalator step comprising at least one single-piece L-shaped tread body, two side cheeks, and a supporting profile. The single-piece tread bodies are packed into transport crates in a manner stacked into one another in such a way that their respective tread element portions and their respective riser element portions abut each other. Spaces present in the transport crates containing the single-piece tread bodies can be filled with supporting profiles and side cheeks. It may be necessary to fill other transport crates with supporting profiles and side cheeks. It goes without saying that the single-piece tread bodies, the side cheeks, and the supporting profiles can also be packed into transport crates separately. Preferably, these transport crates are adapted to the loading gauge of the ISO containers so as to waste as little transport volume as possible. After having been transported, the plug-in parts are unpacked at the assembly site and escalator steps are plugged together therefrom using the plug-in connections formed on said parts. The escalator step is assembled by firstly arranging a supporting profile between two side cheeks, plugging said profile and cheeks together, and then plugging a single-piece tread body to the side cheeks and to the supporting profile arranged therebetween. At least one of the plug-in connections of the plugged-together escalator step is then secured.

BRIEF DESCRIPTION OF THE DRAWINGS

The escalator step comprising plug-in parts will be explained in more detail below on the basis of examples and with reference to the drawings, in which.

DETAILED DESCRIPTION

Figure 1:
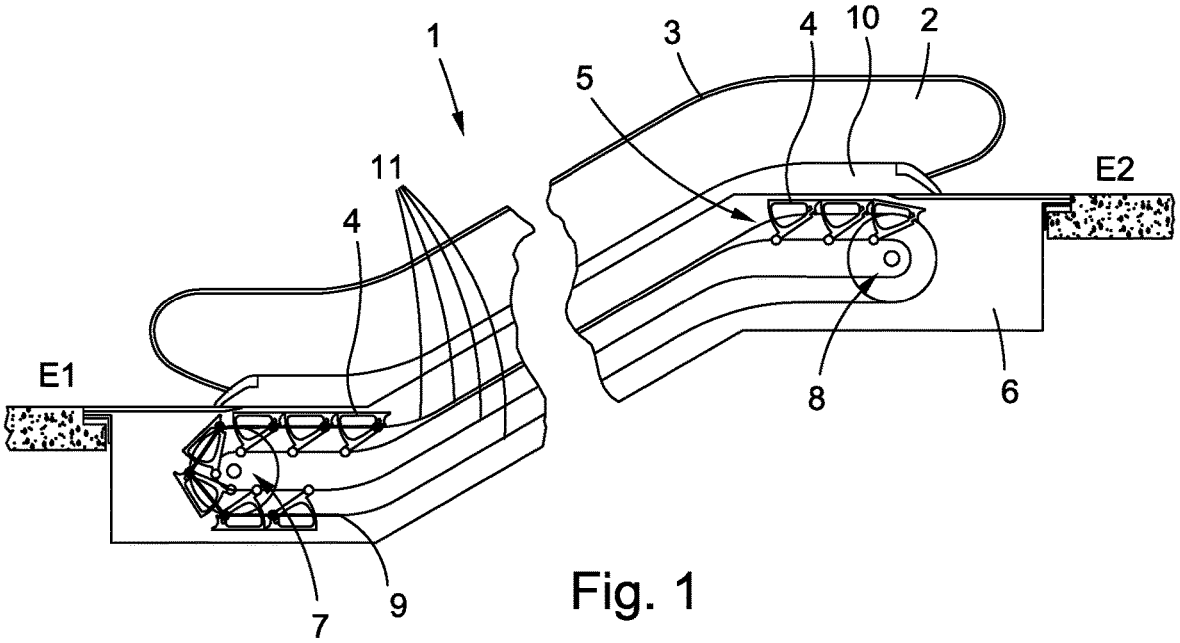
FIG. 1 is a schematic view of an escalator step comprising a load-bearing structure or structural framework and two deflection portions, runner rails being arranged in the load-bearing structure and a circulating step band having escalator steps being arranged between the deflection regions.

FIG. 1 is a schematic side view of an escalator 1 that joins a first floor E1 to a second floor E2. The escalator 1 comprises a load-bearing structure 6 or structural framework 6 having two deflection regions 7, 8 between which a step band 5 is guided in a circulating manner. To guide the step band 5, runner rails 11 or tracks 11 arranged between the deflection portions 7, 8 are used. The step band 5 (only shown in part) comprises tensioning means or mechanism 9 on which escalator steps 4 are arranged. A handrail 3 is arranged on a balustrade 2. The balustrade 2 is connected to the load-bearing structure 6 at the lower end by means of a balustrade base 10.

Figure 2:
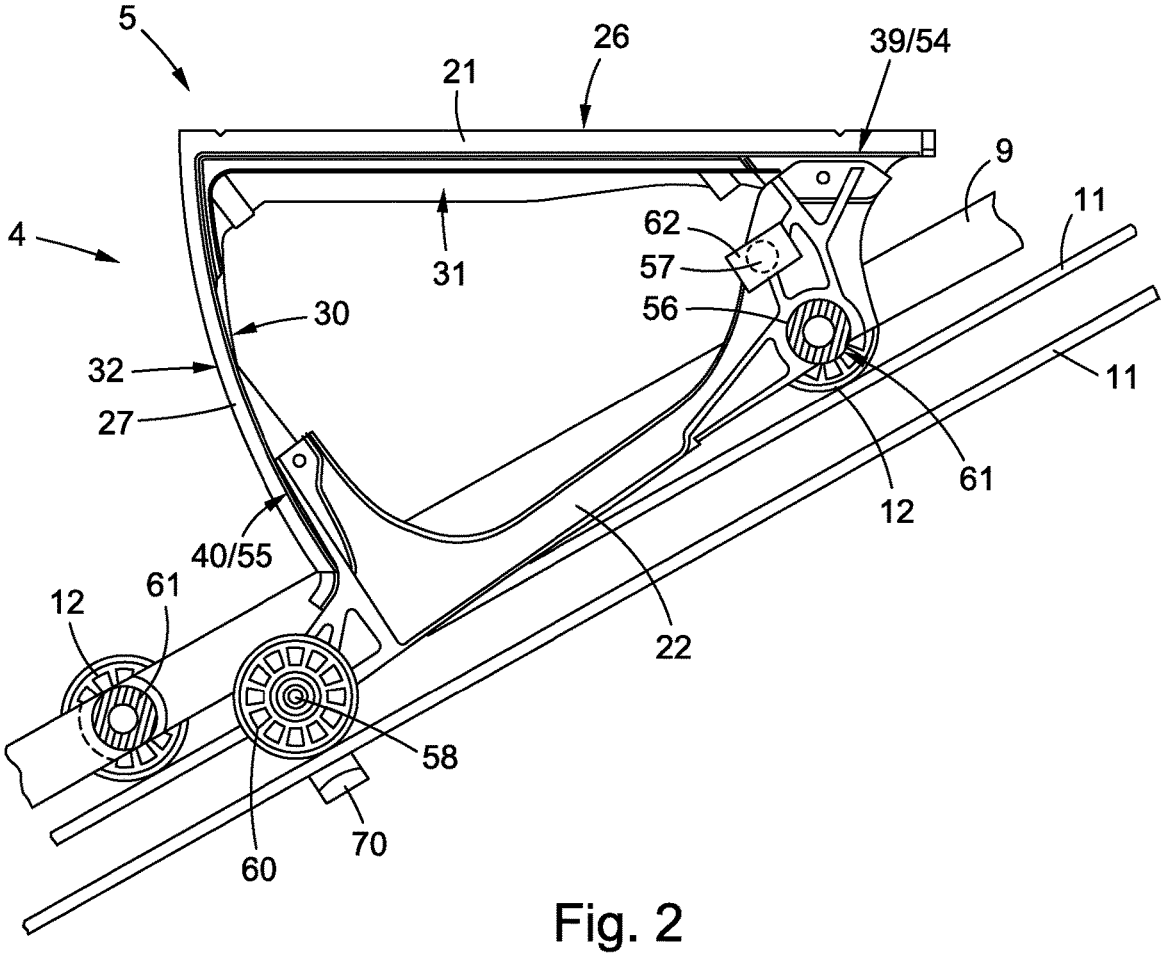
FIG. 2 is a side view of an escalator step consisting of plug-in parts.
Figure 3:
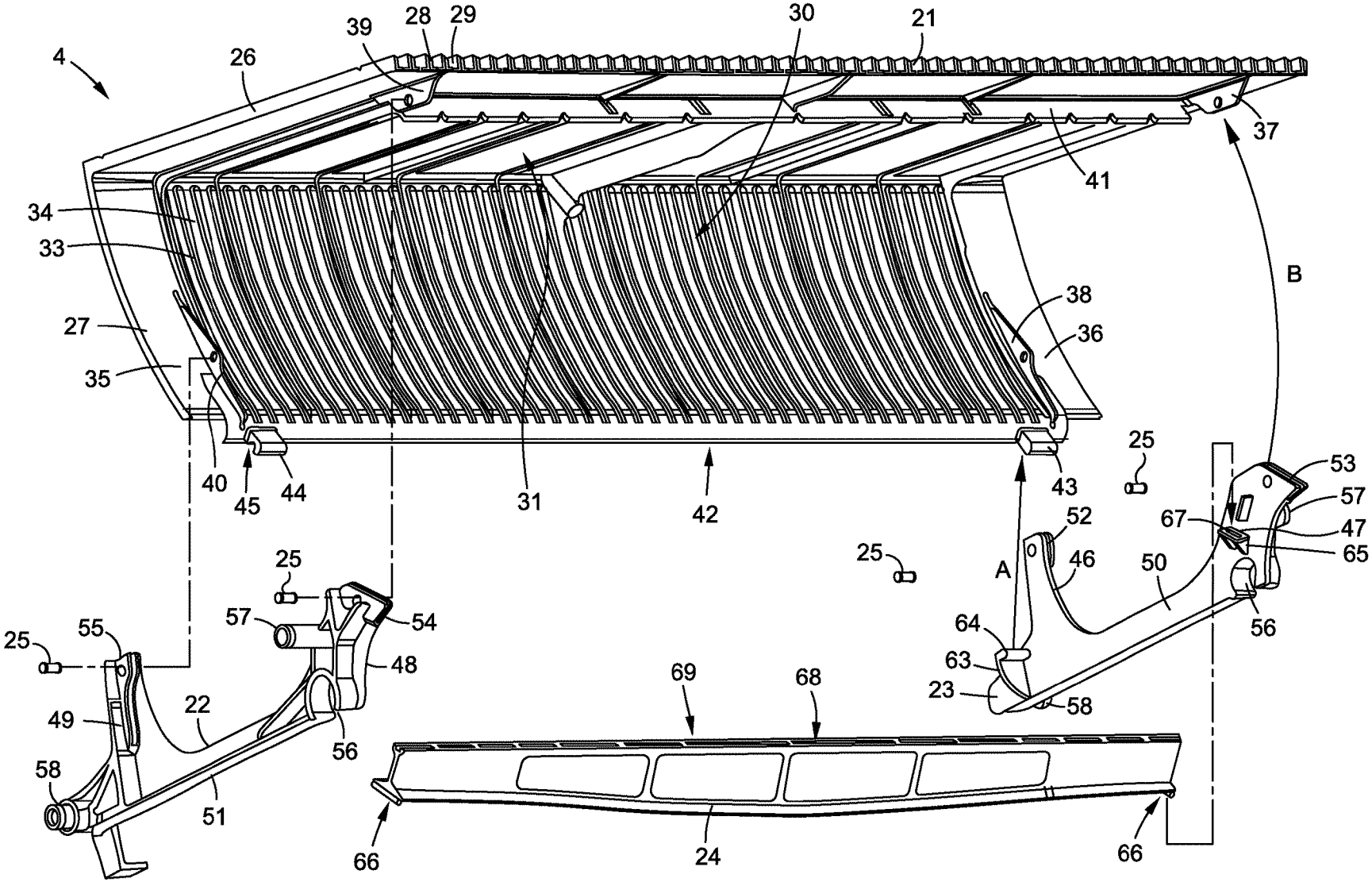
FIG. 3 is an exploded view of the escalator step shown in FIG. 2.

FIG. 2 is a side view of an escalator step 4 of the step band 5 shown in FIG. 1, and FIG. 3 is an exploded view of the escalator step 4 shown in FIG. 2. Both FIG. 2 and FIG. 3 will be described together below.

The escalator step 4 in question substantially comprises a single-piece tread body 21, two side cheeks 22, 23, and a supporting profile 24, which are formed as plug-in parts.

The single-piece tread body 21 comprises a tread element portion 26 and a riser element portion 27. The tread element portion 26 is flat and has a tread pattern consisting of ribs 28 and grooves 29. The riser element portion 27 is curved and adjoins an edge of the tread element portion 26 in an approximately orthogonal direction, such that the riser element portion 27 and the tread element portion 26 are integrally interconnected and form an L-shaped cross section of the single-piece tread body 21. The concave inner face 30 of the riser element portion 27 faces towards the underside 31 of the tread element portion 26 facing away from the ribs 28 and grooves 29. On its convex outer face 32, the riser element portion 27 also comprises ribs and grooves (not visible). To design the riser element portion 27 to be as light as possible but still resistant to deformation, the concave inner face 30 also comprises grooves 33 and ribs 34. In the region of the sides 35, 36 of the single-piece tread body 21, where the side cheeks 22, 23 are intended to be fastened, protrusions 37, 38, 39, 40 in the form of tabs are formed on the underside 31 and on the concave inner face 30. In addition, a serrated protrusion 41 extending across the width of the tread element portion 26 is formed on the underside 31. On the lower edge 42 of the riser element portion 27, two lugs 43, 44 are arranged, in which recesses 45 are formed.

The two side cheeks 22, 23 are formed substantially in mirror-symmetry with one another. They each comprise two bracket portions 46, 47, 48, 49, which are interconnected at one end by means of a bar 50, 51. At their other end, the bracket portions 46, 47, 48, 49 each comprise a tab-shaped recess 52, 53 54, 55, the shape of which corresponds to the associated protrusions 37, 38, 39, 40 formed on the single-piece tread body 21, and form plug-in connections therewith. In addition, fastening regions 56, 57, 58 for fastening add-on parts (see also FIG. 2) are formed on the side cheeks 22, 23.

These are:

- an idling roll fastening region 58 for fastening an idling roll 60,
- a step spindle fastening region 56 for fastening a step spindle 61, and
- a guide fastening region 57 for fastening a sliding guide element 62.

The idling roll fastening region 58 is arranged on the side cheek 22, 23 in alignment with the bar 50, 51 such that it is arranged in the region of the riser element portion 27 so as to protrude outward from the escalator step 4 and project to the side when the escalator step 4 is plugged together. The step spindle fastening region 56 and the guide fastening region 57 are arranged on the extension of the side cheek 22, 23 facing away from the riser element portion 27, the guide fastening region 57 also being arranged so as to protrude outward and project to the side. In this respect, "outward" should be understood to be the space surrounding the plugged-together escalator step 4, whereas "inward" is defined as the internal space enclosed by the plugged-together escalator step 4.

In addition, two inwardly protruding extension pieces 63, 65 are integrally shaped on the side of each of the side cheeks 22, 23 (only visible on the right-hand side cheek 23 in FIG. 3). The second extension piece 65 is arranged above the step spindle fastening region 56 and comprises a recess 67, into which a protrusion 66 formed on the supporting profile 24 can be inserted. The first of these extension pieces 63 comprises a protrusion 64, which corresponds to the recess 45 in the lug 43, 44 formed on the single-piece tread body 21.

On its upper edge 69, the supporting profile 24 comprises a number of recesses 68 adapted to the serrated protrusion 41 on the single-piece tread body 21.

The escalator step 4 is put together substantially in three steps; to aid understanding, the reference numerals of joined plug-in connections are written as "protrusion reference numeral/recess reference numeral."

In the first step, the two side cheeks 22, 23 and the supporting profile 24 are joined together to form a step skeleton by plugging together the plug-in connections 66/67 provided for this purpose.

In the second step, to connect the step skeleton to the single-piece tread body 21, the protrusions 64 on the side cheeks 22, 23, which protrusions are integrally shaped on the first extension pieces 63, are firstly inserted into the associated recesses 45 in the lugs 43, 44. By way of example, the parts are plugged together linearly, as indicated in FIG. 3 by the arrow A. These plug-in connections 64/45 now function as hinges, and so the side cheeks 22, 23 can then be pivoted about this plug-in connection 64/45 until the protrusions 37, 38, 39, 40, 41 on the single-piece tread body 21 penetrate the recesses 52, 53, 54, 55, 68 in the side cheeks 22, 23 and in the supporting profile 24. The plug-in connections 37/53, 38/52, 39/54, 40/55 are plugged together by the pivoting, e.g., in a curved manner, as indicated by arrow B in FIG. 3.

In the third step, the plug-in connections 37/53, 38/52, 39/54, 40/55 of the bracket portions 46 47, 48, 49 are secured using, for example, rivets 25 acting as securing means or mechanisms 25. These can be given extraordinarily small dimensions since the plug-in connections 37/53, 38/52, 39/54, 40/55 are designed such that the largest forces between the plug-in parts 21, 22, 23, 24 are absorbed by the interlocking of the plug-in connections 37/53, 38/52, 39/54, 40/55, 41/68, 64/45, 66/67 themselves and not by the securing means or mechanisms 25. It goes without saying that other securing means or mechanisms 25 can also be used, for example, by caulking (targeted deformation of the plugged-together plug-in connection), clinching, gluing, or welding the plug-in connections 37/53, 38/52, 39/54, 40/55, and the like.

The escalator step 4 is then completed by the add-on parts 60, 61, 62, as shown in FIG. 2. To brace the escalator step 4 against gravity in the region of the riser element portion 27, the idling roll 60 is rotatably arranged at the idling roll fastening region 58. In the installed state, said roll is supported on the runner rails 11 of the escalator 1.

The sliding guide element 62, which can be fitted to the guide fastening region 57 of the side cheek 22, 23, is provided as a further add-on part on each side cheek 22, 23. The sliding guide element 62 guides the step band 5 in the sideways direction on a base plate of the balustrade base 10 if, for reasons of wear and tear, the step band 5 tends to run towards the side out of the running direction or track provided by the tensioning means 9.

Figure 4A:
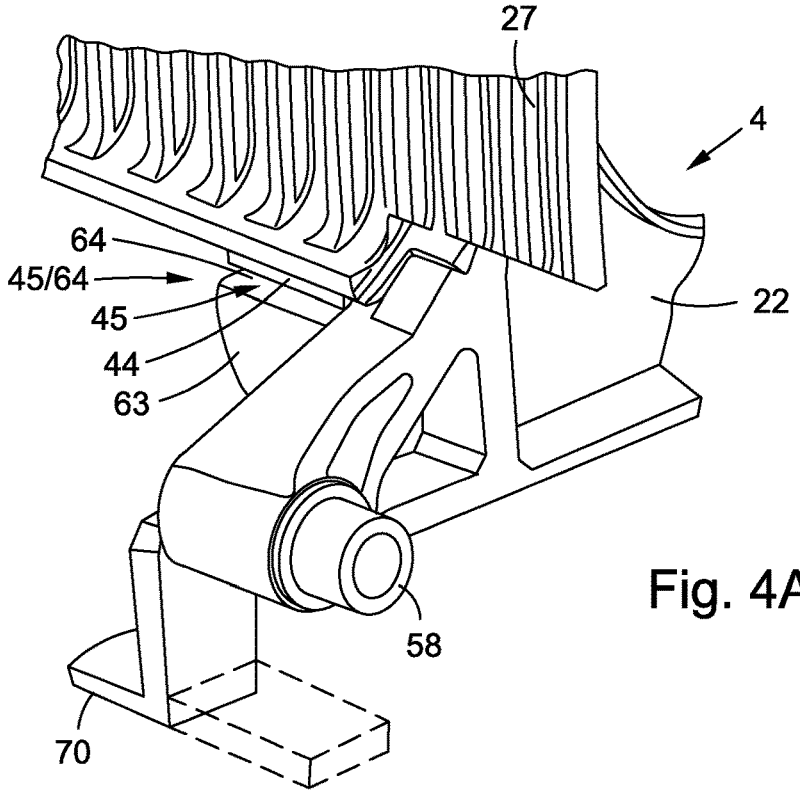
FIGS. 4A to 4D are three-dimensional detailed views of plug-in connections of the escalator step shown in FIGS. 2 and 3, without add-on parts.
Figure 4B:
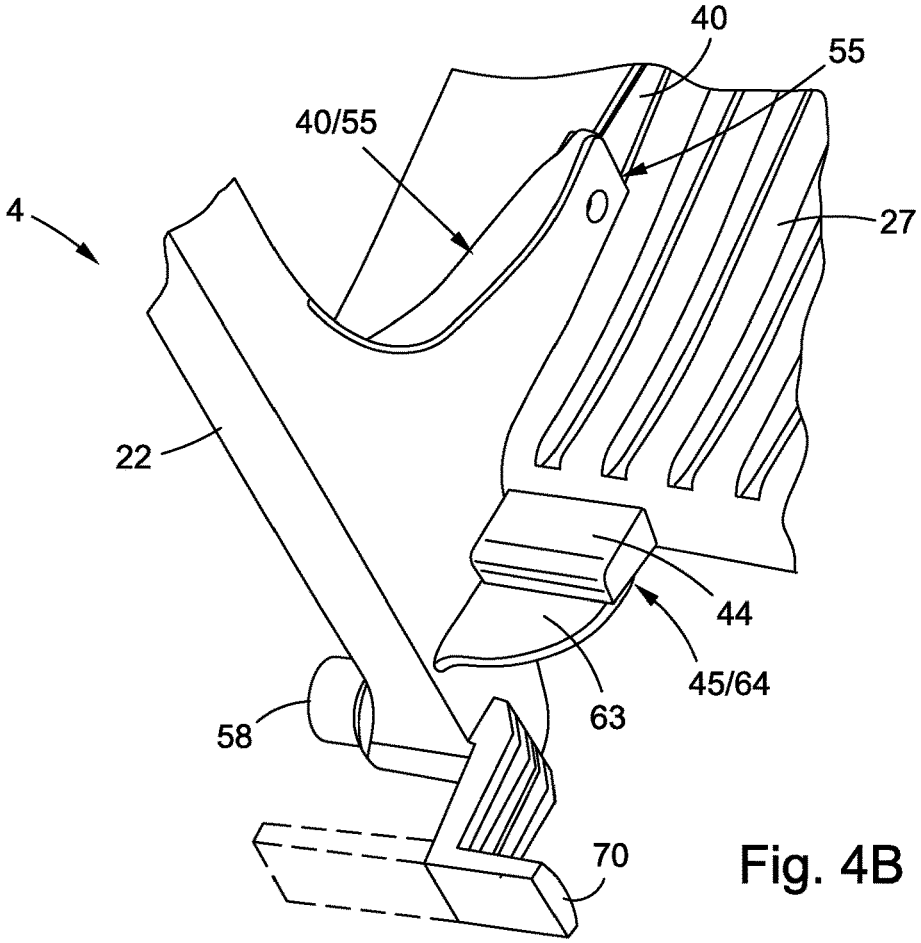

The individual plug-in connections 37/53, 38/52, 39/54, 40/55, 41/68, 45/64, 66/67 of the escalator step 4 shown in FIG. 3 are clearly visible in FIG. 4A to 4D. In this regard. FIGS. 4A and 4B (using the example of the side cheek 22 shown on the left in FIG. 3) show the same plug-in connections 40/55, 45/64 from different viewing angles. From the viewing angle in FIG. 4A, directed from outside towards the cut-out of the escalator step 4, it can be seen how the protrusion 64 formed on the first extension piece 63 penetrates the recess 45 in the lug 44. An emergency guide hook 70 is arranged beneath the idling roll fastening region 58. In the finished escalator 1, said hook engages in an emergency guide rail (not shown). As shown with a dashed line, the emergency guide hook 70 can also protrude in the same direction as the idling roll fastening region 58 or the idling roll spindle 58. In this case, there is no need to install a separate emergency guide rail since the emergency guide hook 70 engages below the runner rail 11 of the idling roll 60.

In FIG. 4B, it can also be seen how the protrusion 40 arranged on the riser element portion 27 is inserted in the recess 55 in the side cheek 22.

Figure 4C:
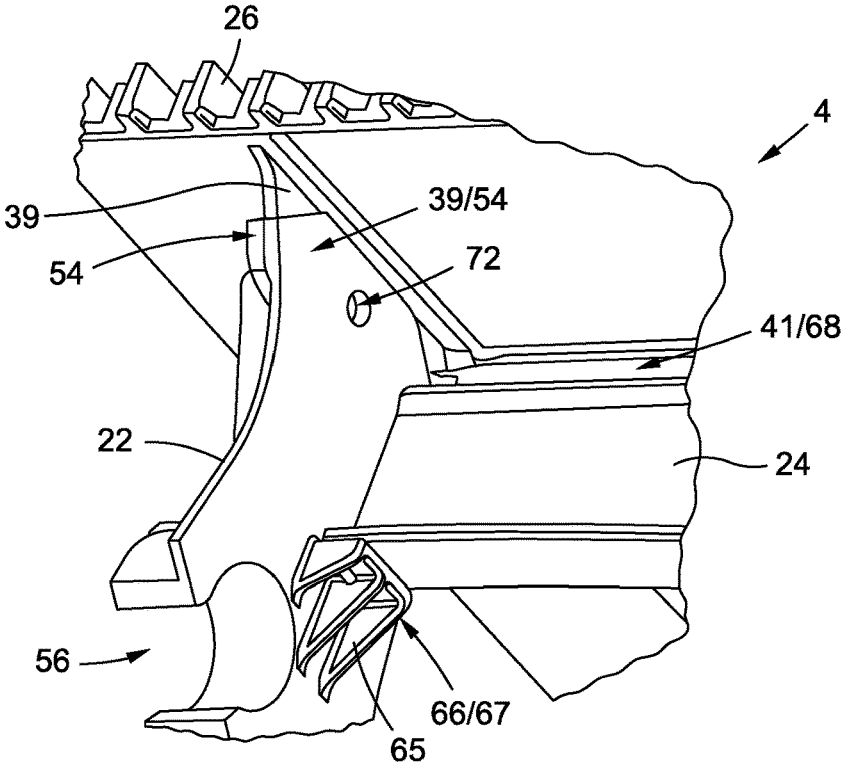
Figure 4D:
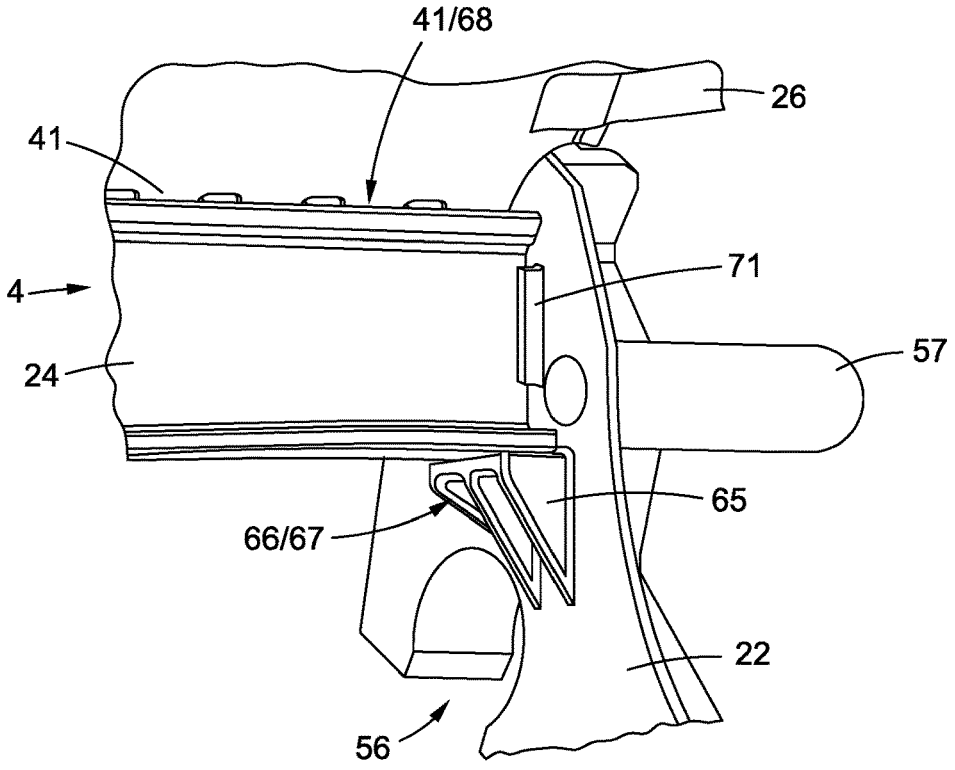

FIGS. 4C and 4D (again using the example of the side cheek 22 shown on the left in FIG. 3) show the plug-in connections 39/54, 41/68, 66/67 close to the step spindle fastening region 56 from different viewing angles. In particular, it is particularly clear in FIG. 4D how the supporting profile 24 is caught by the plug-in connections 41/68, 66/67 between the serrated protrusion 41 of the tread surface 26 and the second lateral extension piece 65 of the side cheek 22. As a result, there is no need to secure these plug-in connections 41/68, 66/67 and the proposed structure drastically reduces the assembly work for the escalator step 4.

A rib 71 is formed on the side cheeks 22, 23 to further stabilize the supporting profile 24 and as an assembly aid (see FIG. 4D). It can also be seen in FIG. 4C how the protrusion 39 arranged on the tread element portion 26 is inserted in the recess 54 in the side cheek 22. The hole 72 for the securing element 25 is also clearly visible.

As already described above on the basis of FIG. 2, the fully assembled escalator steps 4 are arranged between two tensioning means or mechanisms 9 (only one is visible in FIG. 2). The tensioning means or mechanisms 9 in the present embodiment is a sprocket chain 9 provided with castors 12. In the escalator 1, the castors 12 are guided or braced against gravity by the runner rails 11. The tensioning means or mechanisms 9 can also be a pulley or a wire rope.

The tensioning means or mechanisms 9 are arranged in parallel with one another in the escalator 1 and are interconnected by means of the step spindles 61. The escalator steps 4 are suspended on said step spindles 61. For this suspension, a step spindle fastening region 56 in the form of a step eye 56 is formed on each side cheek 22, 23, as already mentioned. In this case, the escalator step 4 must be arranged so as to be pivotable about the step spindle 61 so that, together with other escalator steps 4, it can form a horizontal portion in the deflection region 7, 8 and a step in the diagonal central portion of the escalator 1.

Figure 5:
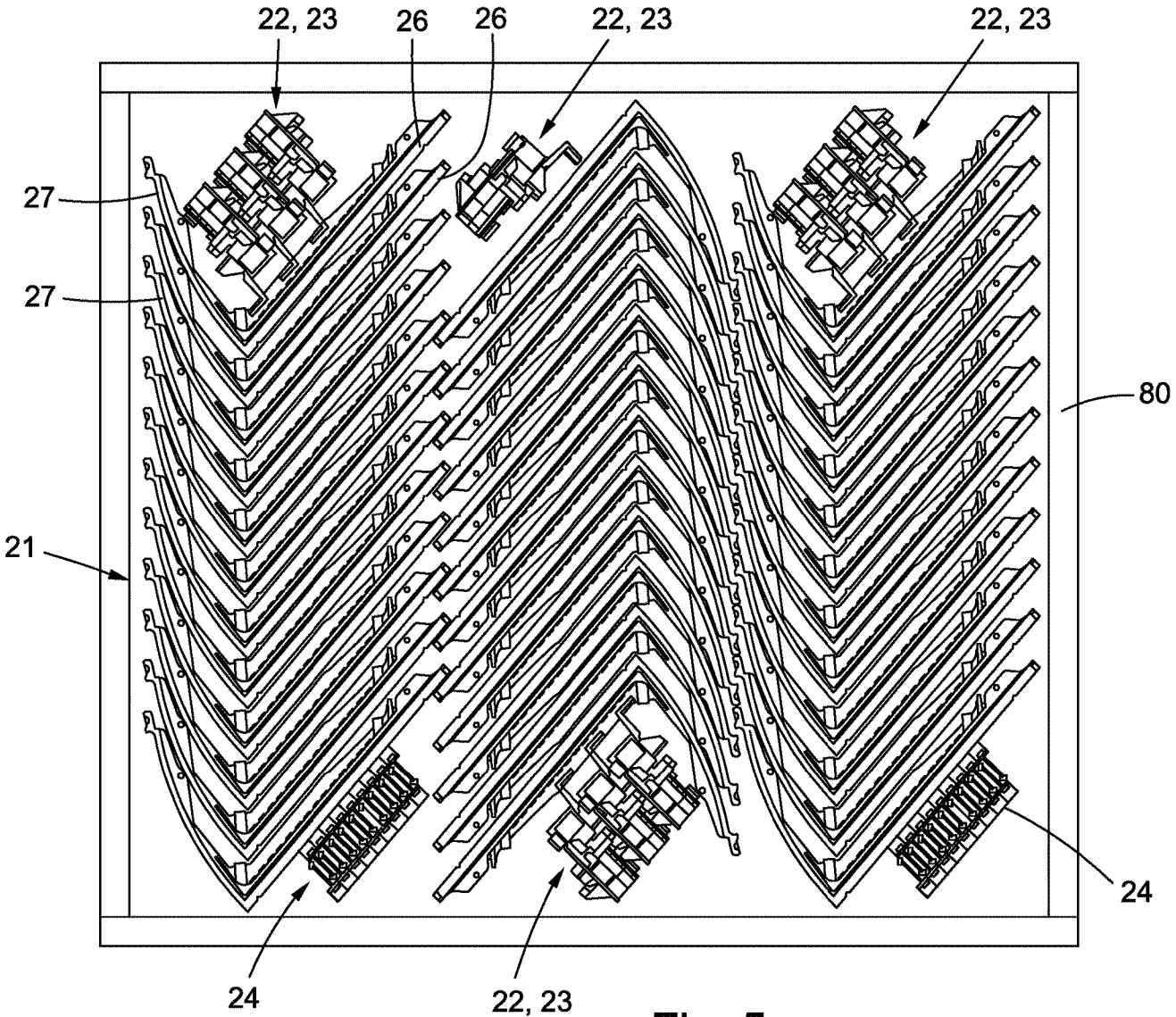
FIG. 5 is an outline of a transport crate showing one possible arrangement of plug-in parts of the escalator step using as much of the available transport volume as possible.
Figure 6:
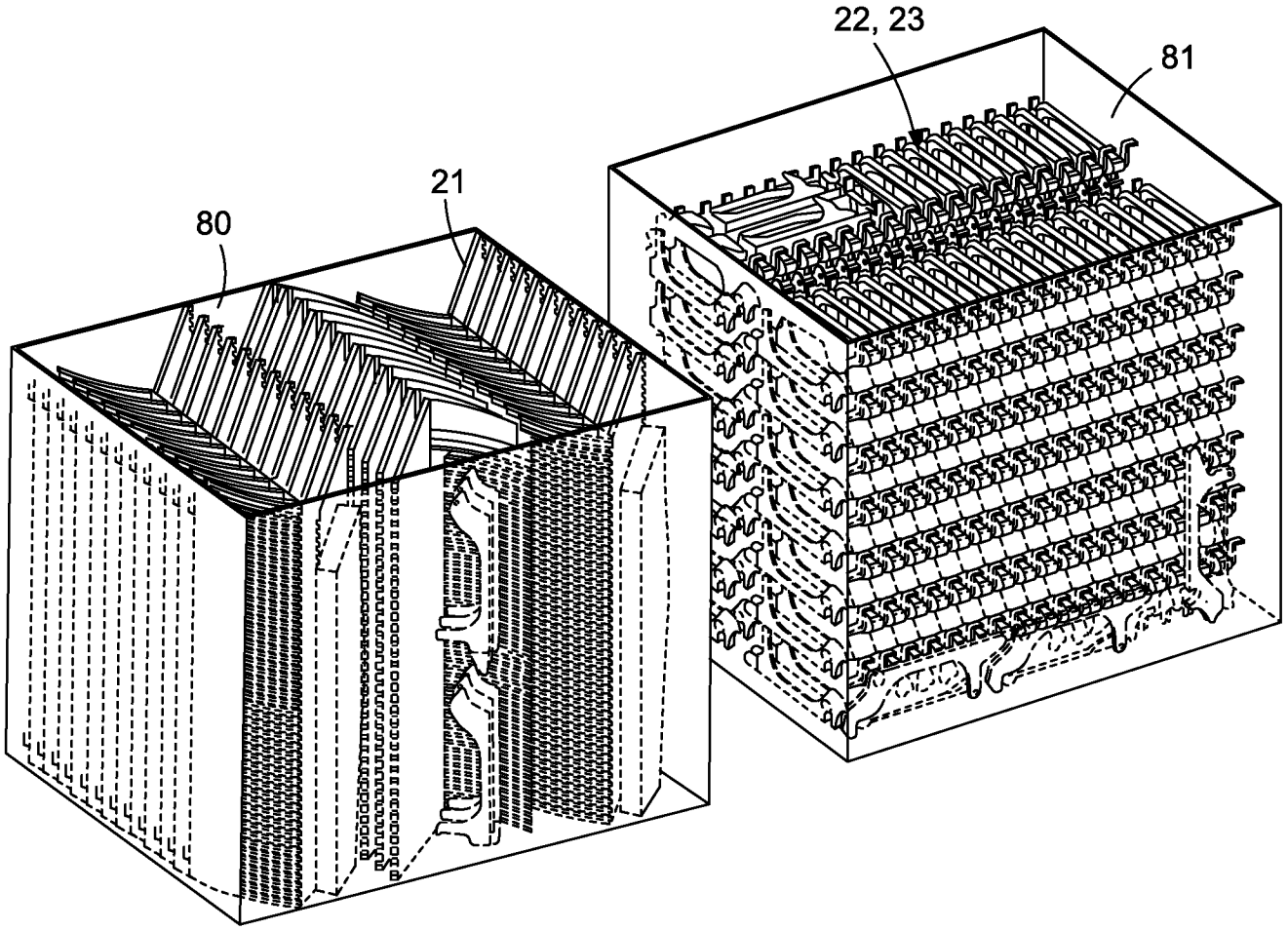
FIG. 6 is a three-dimensional view of the transport crate shown in FIG. 5 containing the single-piece tread bodies, and an additional transport crate containing side cheeks.

FIGS. 5 and 6 clearly illustrate a main advantage of the pluggable escalator step 4. The transport crate 80 in FIG. 5 (shown as an outline) shows a possible arrangement of plug-in parts 21, 22, 23, 24 of the escalator step 4 while using as much of the available transport volume as possible. The single-piece tread bodies 21 are packed into transport crates 80 in a manner stacked into one another such that the respective tread element portions 26 and the respective riser element portions 27 of the stacked single-piece tread bodies 21 abut each other. Spaces present inside the transport crates 80 containing the single-piece tread bodies 21 can be filled with supporting profiles 24 and side cheeks 22, 23. It may be necessary to fill additional transport crates 81 with supporting profiles 24 and side cheeks 22, 23, as shown in FIG. 6. It goes without saying that the single-piece tread bodies 21, the side cheeks 22, 23, and the supporting profiles 24 can also be packed into transport crates 80, 81 separately. Preferably, said transport crates 80, 81 are adapted to the loading gauges of the ISO containers so as to waste as little transport volume as possible among the transport crates 80, 81.

After having been transported, the plug-in parts 21, 22, 23, 24 are unpacked and the escalator steps 4 are put together by plugging together the plug-in parts 21, 22, 23, 24 and securing at least one of the plug-in connections 37/53, 38/52, 39/54, 40/55, 41/68, 45/64, 66/67.

Although the features of this application have been described by illustrating specific embodiments, it is obvious that numerous additional variants can be created within the context of the present disclosure, for example, by additionally providing a central cheek that is designed in the same way as the side cheeks 22, 23, connected to the single-piece tread body 21 and/or to the supporting profile 24 using plug-in connections, and arranged between the side cheeks 22, 23. In addition, the single-piece tread body 21 need not necessarily be an aluminum cast part. The single-piece tread body 21 can also be worked from a blank or produced as a forged part by means of a die. It goes without saying that the single-piece tread body 21 can also comprise sheet metal parts, in particular, deep-drawn sheet metal parts, permanently interconnected by means of gluing or welding. Furthermore, the single-piece tread body 21 can be made of a glass-fiber-reinforced and/or carbon-fiber-reinforced plastics material, or a different composite material. In addition, the single-piece tread body 21 can be made at least in part of a natural stone such as granite or marble, or of an amorphous material such as glass.

The invention claimed is:

1. An escalator step, comprising:

a single-piece tread body having a tread element portion and a riser element portion, the tread element portion and the riser element portion forming an L-shaped cross section of the single-piece tread body;

two side cheeks configured to be arranged on both sides of the single-piece tread body; and at least one supporting profile configured to be arranged between the side cheeks, wherein the single-piece tread body, the side cheeks, and the supporting profile are formed as plug-in parts and comprise plug-in connections, wherein the supporting profile is configured to be plugged to the side cheeks using the plug-in connections and the single-piece tread body is configured to be plugged at least to the side cheeks using the plug-in connections to form a load-bearing frame of an escalator step.

2. The escalator step of claim 1, wherein, when the escalator step is assembled, plugged-together plug-in connections are provided between the single-piece tread body and the side cheeks, between the side cheeks and the supporting profile, and between the single-piece tread body and the supporting profile.

3. The escalator step of claim 1, wherein the plug-in connection can be plugged together in only one assembly direction.

4. The escalator step of claim 3, wherein the assembly direction of the individual plug-in connections is arranged orthogonally to a main loading direction of the respective plug-in connection, such that the largest force acting within the plug-in connection can be absorbed by the interlocking of the plug-in connection.

5. The escalator step of claim 3, wherein the assembly direction is curved such that the plug-in connection can be joined together by means of a pivot movement.

6. The escalator step of claim 3, wherein the assembly direction is linear such that the plug-in connection can be joined together by means of a linear movement.

7. The escalator step of claim 1, wherein each of the plug-in connections comprises at least one protrusion and at least one recess matched to said protrusion in an interlocking manner, wherein the recess is formed in one plug-in part of the escalator step and the protrusion to be inserted into said recess is formed on another plug-in part that adjoins the plug-in part having the recess when in the assembled state.

8. The escalator step of claim 1, wherein at least one of the plug-in connections is secured using a bonded or interlocking securing mechanism.

9. The escalator step of claim 1, wherein the plug-in parts comprise light-metal diecast parts.

10. The escalator step of claim 1, wherein at least two plug-in connections are provided between adjacent plug-in parts to be joined together.

11. The escalator step of claim 1, wherein an emergency guide hook is formed on at least one of the side cheeks, wherein the emergency guide hook protrudes beneath an emergency guide rail or a runner rail of an escalator in which the escalator step is used.

12. The escalator step of claim 1, wherein at least one of the following fastening regions is formed on the side cheeks or on the single-piece tread body in order to fasten add-on components:

an idling roll fastening region for fastening an idling roll, a step spindle fastening region for fastening a step spindle, or a guide fastening region for fastening a sliding guide element.

13. A step band, comprising:

a first tensioning mechanism, a second tensioning mechanism, and a plurality of the escalator steps of claim 1, wherein the escalator steps are arranged between the first and second tensioning mechanisms.

14. An escalator comprising the step band of claim 13 arranged in a circulating manner.

15. A method for producing and assembling an escalator step comprising a single-piece tread body having a tread element portion and a riser element portion, the tread element portion and the riser element portion forming an L-shaped cross section of the single-piece tread body, two side cheeks configured to be arranged on both sides of the single-piece tread body, and at least one supporting profile configured to be arranged between the side cheeks, wherein the single-piece tread body, the side cheeks, and the supporting profile are formed as plug-in parts and comprise plug-in connections, wherein the supporting profile is configured to be plugged to the side cheeks using the plug-in connections and the single-piece tread body is configured to be plugged at least to the side cheeks using the plug-in connections to form an escalator step, the method comprising:

producing the single-piece tread body, side cheeks, and supporting profile, including forming recesses and protrusions for the plug-in connections being on the plug-in parts;

plugging, using the plug-in connections, the plug-in parts of the escalator step together by firstly arranging the supporting profile between two side cheeks, plugging said profile and cheeks together, and then plugging the single-piece tread body to the side cheeks and to the supporting profile arranged therebetween to forma a load-bearing frame of the escalator step; and securing at least one of the plug-in connections using an interlocking or bonded securing mechanism.

16. A method for transporting escalator steps from a production site to an assembly site and for assembling the escalator steps at the assembly site, the method comprising:

producing the escalator steps in the form of plug-in parts at the production site, the plug-in parts of an escalator step comprising at least one single-piece tread body, two side cheeks, and a supporting profile;

packing the single-piece tread bodies into transport crates in a manner stacked into each other such that tread element portions and riser element portions of the stacked single-piece tread bodies abut each other;

filling spaces present in the transport crates containing the single-piece tread bodies with supporting profiles and side cheeks, and/or filling additional transport crates with supporting profiles and side cheeks;

after having been transported to the assembly site, unpacking the plug-in parts and plugging together the escalator steps using the plug-in connections formed on said parts by firstly arranging a supporting profile between two side cheeks, plugging said profile and cheeks together, and then plugging a single-piece tread body to the side cheeks and to the supporting profile arranged therebetween; and securing at least one of the plug-in connections of the escalator step.

17. The method of claim 15, further comprising fastening additional add-on components to the escalator step to complete the escalator step.

* * * * *